United States Patent [19]

Goodwin et al.

[11] Patent Number: 4,554,963

[45] Date of Patent: Nov. 26, 1985

[54] METHOD AND APPARATUS FOR A FLUIDIZED BED HEAT EXCHANGER

[75] Inventors: Alton C. Goodwin, Northport; Mark T. Junglen, Irondale; John S. Kent, Birmingham, all of Ala.

[73] Assignee: Baker International Corporation, Orange, Calif.

[21] Appl. No.: 524,520

[22] Filed: Aug. 19, 1983

[51] Int. Cl.[4] ..... F28C 3/16; F28D 13/00

[52] U.S. Cl. ..... 165/1; 165/95; 165/104.16; 422/146; 422/143

[58] Field of Search ..... 165/104.16, 1, 95; 422/146, 139, 143, 145

[56] References Cited

U.S. PATENT DOCUMENTS

| | | | |
|---|---|---|---|
| 3,991,816 | 11/1976 | Klaren | 165/104.16 |
| 4,401,152 | 8/1983 | Klaren | 165/104.16 |
| 4,427,053 | 1/1984 | Klaren | 165/104.16 |

FOREIGN PATENT DOCUMENTS

| | | | |
|---|---|---|---|
| 1944019 | 3/1971 | Fed. Rep. of Germany | 422/145 |

*Primary Examiner*—Albert W. Davis, Jr.
*Attorney, Agent, or Firm*—Thomas E. Schatzel

[57] ABSTRACT

A fluidized bed heat exchanger having a plurality of tubes for passing a primary medium, a particulate matter bed, and side and base inlet conduits for passing the primary medium fluid into the heat exchanger with the base inlet conduit adapted to receive the primary medium and fluidizing the particulate matter bed. The primary medium passing through the inlet conduits is controllable to maintain a desired amount of fluidized particulate matter within the tubes when descaling is desired and reduced at the base inlet conduit to eliminate the fluidized particulate matter from flowing within the tubes when descaling is not desired while flow of the primary medium through the tubes is maintained.

21 Claims, 3 Drawing Figures

METHOD AND APPARATUS FOR A FLUIDIZED BED HEAT EXCHANGER

BACKGROUND OF THE INVENTION

1. Field of the Invention

The invention relates generally to a fluidized bed heat exchanger system and more particularly to a fluidized bed heat exchanger utilizing specifically designed apparatus to stabilize particulate matter porosity and primary medium fluid flow within the system and improve inner tube surface cleaning and a method for operating same.

2. Description of the Prior Art

There are numerous ways to effect heat transfer between two mediums. Two of the more common means to accomplish such a heat transfer are a medium-medium contra flow heat exchange or a fluidized bed heat exchange. The present invention relates more generally to the fluidized bed heat exchange method than to the medium-medium contra flow method.

Conventional fluidized bed heat exchanger systems pass a primary medium, to be heated or cooled, through a plurality of tubes. These tubes are bathed in a secondary medium, selected to cool or heat the tubes. Fluidized particulate matter, such as glass beads or chopped wire, may be suspended in the flow of the primary fluid to enhance the heat exchange and scrub the inner surfaces of the tubes.

When fluidized particulate matter is utilized in a heat exchange system the particulate matter forms two beds or regions of concentrations within the heat exchanger. The first bed develops at the base of the tubes and surrounds the open base ends of the tubes. Due to the primary medium fluid flow through the first bed a second particulate matter bed develops within each tube. Optimum primary medium fluid flow and heat transfer require that these two particulate matter beds be stable. Maldistribution in the primary medium fluid results in reduced heat transfer between the primary and secondary mediums adversely affecting the system's efficiency. Under certain conditions particular tubes, due to poor primary medium fluid distribution, accumulate larger than desired amounts of particulate matter and develop into unintended "downcomers". These downcomer tubes allow primary medium and particulate material to back flow through the heat exchanger system. This back flow through the downcomers also adversely affects the heat transfer characteristics of the heat exchanger system.

Particulate matter bed stability is enhanced if the density of the particulate beds surrounding the base of the tubes is greater than the density of the particulate matter bed within the tubes and further if the density of the lower regions of the particulate tube beds is greater than the upper regions of the particulate tube beds. Particulate matter bed stability is further increased if the degree of density change between the beds and the regions within the tubes is of a gradual nature.

In some applications it is not necessary to maintain constant fluidization of the particulate matter within the heat exchanger and higher primary medium flow rates can be achieved if the fluidized particulate matter is only present within the system when tube descaling is necessary.

The use of a fluidized bed heat exchanger systems is known in the prior art. Such systems are described in U.S. Pat. Nos. 1,716,333; 3,886,997; 3,991,816; 4,119,139; 4,220,193; and 4,300,625 which disclose the use of fluidized particulate matter in heat exchanger systems.

The majority of the aforementioned patents disclose different designs and apparatus to minimize undesirable internal particulate disturbance in the aforementioned particulate matter beds. U.S. Pat. No. 4,119,139 specifies the use of throttling devices within the tubes of the heat exchanger to affect particulate stabilization. U.S. Pat. No. 3,886,997 discloses the use of fluidized particulate matter of specified size and design to control particulate distribution and reduce high pressure loss. U.S. Pat. No. 4,220,193 prescribes the use of a perforated sieve plate and inlet devices, with lower edges perpendicular to the central axis of the device, attached to the bottom of the tubes as a means to control particulate distribution in the fluidized bed heat exchanger system. U.S. Pat. No. 4,300,625 teaches the use of specially contoured housings in conjunction with prescribed amounts of fluidized particulate matter as a means to stablize particulate disturbances and increase inner tube cleaning.

U.S. Pat. No. 3,991,816 discloses a method for cleaning a fluidized bed heat exchanger. The disclosed method teaches the use of expensive auxiliary apparatus to implement a cleaning procedure and requires interruption of the heat exchanger's operation to utilize the descaling procedure.

One disadvantage of the conventional fluidized bed heat exchanger system relates to the generation of instability in the particulate matter beds resulting in non-uniform primary medium flow rates through the system, adversely affecting the heat exchanger ability to process large quantities of the primary medium over a wide range of primary medium flow rates.

Another disadvantage of the conventional fluidized bed heat exchanger concerns the development of unintended downcomers among the tubes resulting in less than optimal heat transfer between the primary and secondary medium.

Another disadvantage of the conventional fluidized bed heat exchanger system concerns the inability of prior designs to function without distributor or sieve plates. Such plates in certain applications are susceptible to clogging, thus, preventing primary medium flows through said plate and generating turbulence or unintended preferential primary medium flows within the particulate matter bed situated about the distributor or sieve plate. Such preferential flows and turbulence, as discussed, reduce the heat exchanger efficiency thereby decreasing the cost effectiveness of the system.

Another disadvantage of the conventional fluidized bed heat exchanger system concerns the inability of the present systems to use a method for regulating the amount of fluidized particulate matter utilized within the heat exchanger system without interrupting the operation of same.

SUMMARY OF THE PRESENT INVENTION

It is an object of the present invention to provide a method for regulating the use of the fluidized particulate matter within the heat exchanger without interrupting the operation of the heat exchanger.

It is a further object of the present invention to provide an inexpensive, reliable fluidized bed heat exchanger capable of utilizing a method for regulating the use of fluidized particulate matter within the heat exchanger without interrupting the operation of the heat exchanger.

It is a further object of the present invention to provide a fluidized bed heat exchanger design capable of maintaining uniform primary medium flow rates within and among the tubes of the heat exchanger over a wide range of primary medium flow rates.

It is a further object of the present invention to provide a fluidized bed heat exchanger design capable of maintaining stable particulate matter porosity within and among the particulate matter beds residing within the heat exchanger over a wide range of primary medium flow rates.

It is a further object of the present invention to provide a fluidized bed heat exchanger design capable of operation without the use of a perforated distributor or sieve plate.

It is also an object of the present invention to provide a fluidized bed heat exchanger design which helps to avoid the development of unintended downcomers in the heat exchanger system.

Briefly, the preferred embodiment of the present invention includes a fluidized bed heat exchanger having a plurality of parallel heat exchanger tubes capable of transporting a primary medium. The heat exchanger tubes are located in a chamber designed to bathe the tubes in a secondary medium. Positioned at one end of the heat exchanger tubes is a collection chamber in open communication with the heat exchanger tubes. The collection chamber also incorporates an outlet conduit for passing the primary medium.

Located at the opposite end of the heat exchanger tubes is a fluid chamber in open communication with the other end of the heat exchanger tubes which incorporates a side inlet conduit and a base inlet conduit. Both inlet conduits are for passing the primary medium into the fluid chamber. The base inlet conduit is positioned at the base of the fluid chamber while the side inlet conduit is positioned at a predetermined location on at least one side wall of the fluid chamber. The fluid chamber is subdivided into two regions, a primary region and a secondary region. The primary medium region is separated from the secondary region via a tube sheet. Passing through the primary region and terminating in the secondary region are a plurality of tube inlet devices. Each tube inlet device attached to the end of the heat exchanger tube is an extension of the heat exchanger tube and is fixedly mounted in and supported by the tube sheet segregating the two regions. The tube inlet devices include at least two apertures positioned on the side of the device and in parallel alignment with the central axis of each device. The tip of the tube inlet device can be plain or of a unique shape or design so as to encourage uniform flow rates and stable particulate porosity within and among the tubes with little regard to the particulate matter bed concentrations in the fluidized bed region. Also, located in the fluidized bed region is a particulate matter bed positioned about the base inlet conduit. Said particulate matter bed totally surrounds a solid impingement plate. The impingement plate is positioned over the base inlet conduit in such a manner to prevent the backflow of any particulate matter into the base inlet conduit.

In operation, the primary medium to be heated or cooled, is simultaneously passed into the fluid chamber through both base and side inlet conduits. The primary medium entering through the base inlet conduit, encounters the solid impingement plate, fluidizes the particulate matter bed, and fills the secondary region. The primary medium passing through the base inlet conduit and the particulate matter concentrated in the secondary region migrate into the heat exchanger tubes via the inlet devices. The primary medium flowing into the system via side inlet conduit fills the primary region and enters the tube inlet devices through said side apertures. This primary medium commingles with the fluidized particulate matter in the inlet devices and proceeds through the tubes into the collection chamber. The primary medium exits the fluidized bed heat exchanger through the collection chamber outlet conduit while the fluidized particulate matter remains within the heat exchanger. Throughout this process, a secondary medium, designed to heat or cool the primary medium, is passed about the tubes.

It is not always desirable to fluidize the particulate matter in the operation of the system. In some applications greater efficiency can be achieved if the particulate matter is used only when descaling is necessary. Under these conditions it is not necessary to remove the particulate matter from the heat exchanger to prevent such from entering the tubes, but, only to regulate the quantity of the primary medium entering the system through the side and base inlet conduits. Reduction of the quantity of the primary medium entering the system via the base inlet conduit reduces the amount of fluidized particulate matter drawn up into the tubes. A total reduction of the quantity of primary medium flowing into the base conduit results in no particulate material entering the heat exchanger tubes during the heat transfer process. To clean the system, the quantity of the primary medium entering the base inlet conduit is increased sufficiently to cause fluidized particulate matter to enter the heat exchanger tubes and scrub the inner walls of the heat exchanger. Upon completion of such cleaning, the quantity of primary medium entering the system via the base inlet conduit is reduced to prevent further fluidization of particulate matter.

An advantage of the present invention is that it provides a method to concurrently operate and clean the fluidized bed heat exchanger.

Another advantage of the present invention is that it provides a fluidized bed heat exchanger design capable of utilizing a concurrent cleaning method.

Another advantage of the present invention is that it provides a fluidized bed heat exchanger capable of maintaining stable particulate matter porosity and uniform primary medium flow rates within and among the tubes over a wide range of flow rates of the primary fluid.

Another advantage of the present invention is that it helps prevent unintended downcomers from developing within the fluidized heat exchanger system.

Another advantage of the present invention is that it minimizes the effect of low particulate matter levels in the secondary region bed on the stability of the particulate matter porosity concentrations located within the tubes.

These and other objects and advantages of the present invention will no doubt become obvious to those of ordinary skill in the art after having read the following detailed description of the preferred embodiments which are illustrated in the various drawing figures.

IN THE DRAWINGS

DETAILED DESCRIPTION OF THE PREFERRED EMBODIMENT

Figure 1:
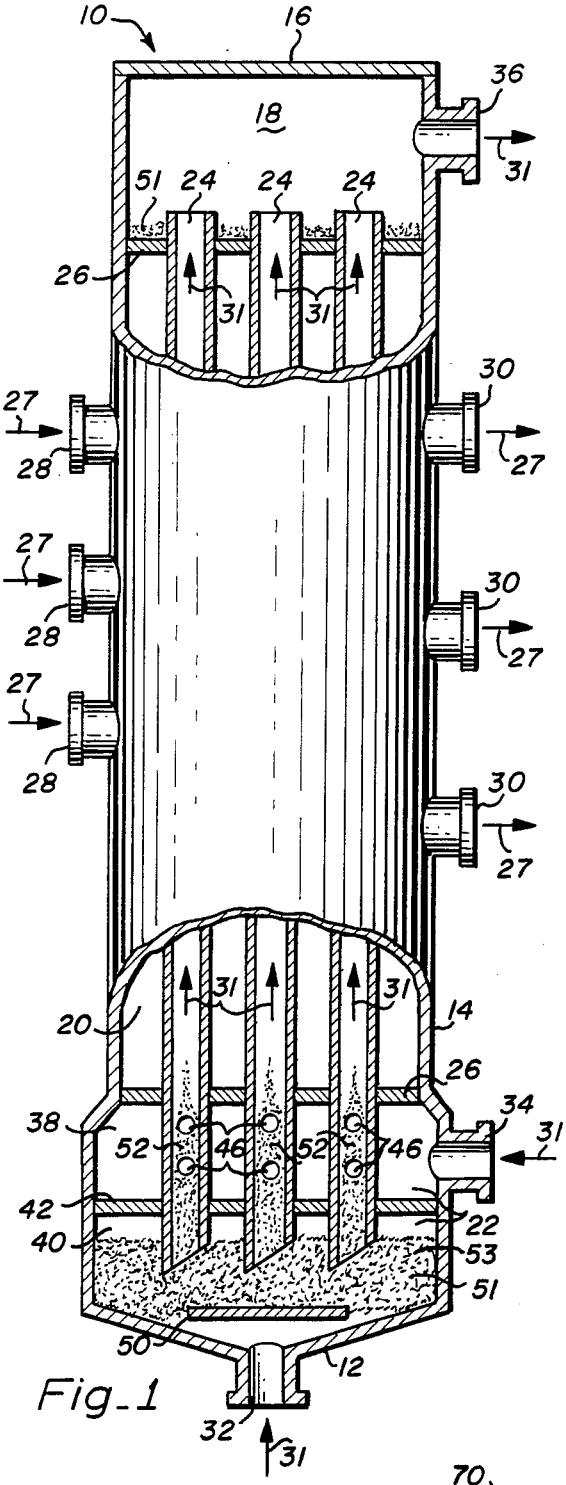
FIG. 1 is a partially sectional elevational view of a fluidized bed heat exchanger in accordance with the present invention.

Referring to FIG. 1 there is shown a fluidized bed heat exchanger referred to by general reference character 10. The fluidized bed heat exchanger 10 has a base 12, a wall 14, a top surface wall 16, a collection chamber 18, at least one middle chamber 20 and a fluid chamber 22. Through these chambers 18, 20 and 22 pass a plurality of substantially parallel heat exchanger tubes 24. Tubes 24 are fixedly mounted in and supported by a pair of tube sheets 26 located near the opposite terminal ends of the tubes 24. The tube sheets 26 also serve to segregate the middle chamber 20 from the collection chamber 18 and the fluid chamber 22 in a fluid tight leak proof manner.

The middle chamber 20 functions as a heat exchanger element through which a secondary medium or mediums 27 pass bathing tubes 24. The secondary medium 27 entering the middle chamber 20 does so via a plurality of middle chamber inlet conduits 28 and exits the middle chamber 20 via a plurality of middle chamber outlet devices 30.

While the secondary medium 27 is in contact with tubes 24 a primary fluid 31 flows through tubes 24 from fluid chamber 22 to the collection chamber 18. The primary medium 31 enters the fluid chamber 22 simultaneously through a base inlet conduit 32 located at the bottom of lower chamber 22 and a side inlet conduit 34 located in side wall 14 of fluid chamber 22. The base and side inlet conduits 32 and 34 are fixedly mounted in chamber 22 in a leak proof manner. The primary medium 31 exits the fluidized bed heat exchanger 10 from the collection chamber 18 via collection chamber outlet conduit 36.

Heat exchanger tubes 24 are commonly constructed of smooth pipe. Such tubes 24 can also be fabricated so as to include fins or protrusions to enhance heat transfer between the tubes 24 and the secondary medium 27.

The collection chamber 18 and the fluid chamber 22 are both in open fluid communication with the tubes 24.

Fluid chamber 22 is subdivided into two regions, i.e. a primary region 38 and a secondary region 40. The two regions 38 and 40 are separated by a partition in the form of tube sheet 42. Originating in primary medium region 38, passing through tube sheet 42 and terminating in secondary region 40 are a plurality of parallel inlet devices 44. Each of inlet devices 44 is attached to the fluid chamber end of one of the tubes 24 and fixedly supported by tube sheet 42. In some applications inlet devices 44 are extensions of heat exchangers tubes 24 and are not separate devices. Both primary and secondary regions 38 and 40 are in open fluid communication with inlet devices 44. Located in the wall of each of the inlet devices 44 and residing within the primary medium region 38, are at least two apertures 46. Apertures 46 are positioned in the side of inlet device 44 in a parallel alignment with the central axis of inlet device 44. Apertures 46 may also be positioned on different sides of device 44. The only requirement is that the apertures be positioned one above the other such that primary medium entering the lower aperture 46 will pass by the upper aperture 46 as it proceeds through the exchanger 10. The size and placement of said apertures 46 is determined by the following equations:

$$\tfrac{1}{2}D_N \leqq A_N \leqq (L-\tfrac{1}{2}D_N);$$

and $$0.004[OD^2] \leqq [D_1^2+D_2^2+D_3^2+\ldots D_N^2] \leqq 3[OD^2]$$

where

N = the number of the apertures 46

$D_N$ = the diameter of the Nth aperture 46

OD = the overall diameter of inlet devices 44

L = the overall length of inlet devices 44

$A_N$ = the distance from the lower edge of inlet device 44 to the center point of the Nth aperture 46.

The geometry of an example of tube 44 which has been tested is as follows: N = 2; $D_1 = D_2 = 0.75$ inches; OD = 2 inches; L = 16 inches; $A_1 = 4$ inches; and $A_2 = 13$ inches.

Apertures 46 allow the primary medium 31 flowing into the fluidized heat exchanger 10 via side inlet conduit 34 to enter inlet devices 44 and flow through tubes 24.

Contained within the secondary region 40 is a solid impingement plate 50 positioned about base inlet conduit 32. Impingement plate 50 is designed to prevent particulate matter (to be described hereinafter) from leaving the fludized bed heat exchanger 10 via base inlet 32, to prevent damage to heat exchanger 10 internal structure due to contact with high pressure primary medium 31 entering the heat exchanger via conduit 32 and to disperse the primary medium 31 in a uniform manner throughout secondary region 40.

Surrounding solid impingement plate 50 and enclosing the tips of inlet devices 44 is a bed of particulate matter 51. The particulate matter 51 is of a size and shape so as to freely enter the inlet devices 44 and tubes 24. Particulate matter 51 can be of any material that does not decompose when in contact with primary medium 31 and is capable of descaling the inner walls of tubes 24 when fluidized, i.e. glass beads or chopped wire. In operation a bed of particulate matter 51 is suspended in inlet devices 44 and in tubes 24. Such a concentration of particulate matter 51 within the tubes is known as a tube bed 52 while any concentration of particulate matter 51 in the secondary region 40 is known as a secondary region bed 53.

Empirical data generated by the inventors has demonstrated that the positioning of the apertures 46, as discussed above, improves the stability of tube bed 52 porosity thus providing a uniform primary medium 31 flow rate within tubes 24. The tube bed 52 porosity is stablized due to the ability of the aperture 46 to generate a gradual density transition within the tube bed 52, from dense concentrations of particulate matter 51 at the fluid chamber end of tube bed 52 to less dense concentrations of particulate matter 51 at the collection end of tube bed 52. Such gradual transition is not possible when conventional single aperature inlet devices are used.

Figure 3:
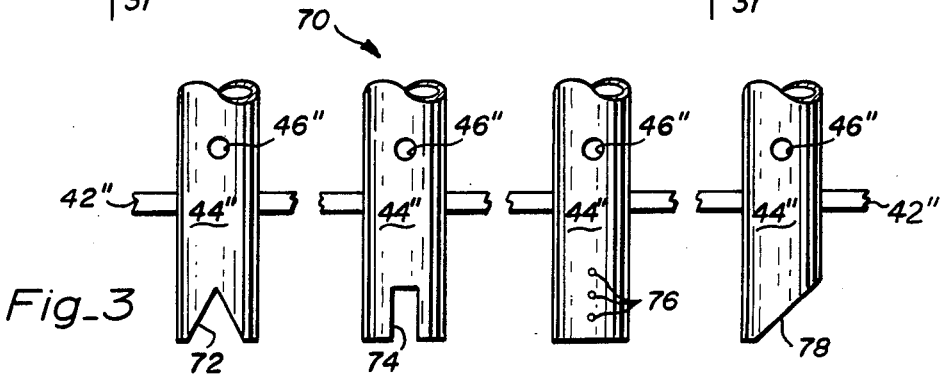
FIG. 3 is an elevational view of four different designs for tube inlet devices in accordance with the fluidized bed heat exchanger of FIG. 1.

The configuration of the tips of the inlet devices 44 are more clearly shown in FIG. 3. The disclosed configurations reduce the susceptibility of tube bed 52 to fluctuations in the secondary region bed 53. Under normal circumstances the secondary region bed 53 totally surrounds the tips of inlet devices 44, but, when the secondary region bed 53 is reduced to a level below or just equal to the base of the tips of inlet devices 44 slight fluctuations in height of the secondary region bed 53 has significant effects on tube bed 52 porosity. When the secondary region bed 53 surrounds the tips of inlet devices 44, less primary medium 31 enters tubes 24. When a portion of or all of the tips of inlet devices 44 are exposed due to reduced height in the secondary region bed 53, large quantities of primary medium 31 flow into the inlet devices 44 and into tubes 24. As discussed, inlet device 44 tips (as shown in FIG. 3) ensure that any decrease in the height of secondary region bed 53 will not result in significant increases in the amount of primary medium 31 allowed to enter tubes 24. By preventing sudden fluctuations in the amount of primary medium 31 allowed to flow into tube bed 52 porosity and primary medium 31 flow rates are stablized and made more uniform within and among tubes 24.

The particulate matter 51 serves two purposes. It enhances heat exchange and cleans the inner surfaces of tubes 24 by contacting and descaling the inner surfaces of tubes 24 as it flows within the tubes 24 in a fluidized state with primary medium 31.

In operation heat exchanger 10 operates by simultaneously introducing primary medium 31 into side and base inlet conduits 32 and 34. The primary medium entering via side inlet conduit 34 fills primary region 38 and enters apertures 46. The primary medium 31 entering the heat exchanger 10 via base conduit 32, encounters impingement plate 50, and fluidizes the secondary region bed 53 and enters inlet devices 44. After entering tube 24 primary medium 31 propels a portion of tube bed 52 through tube 24. After passing through tube 24, both primary medium 31 and particulate matter 51 enter collection chamber 18 wherein particulate matter 51 is retained and primary medium 31 is expelled from the heat exchanger 10 via outlet conduit 36.

In conventional fluidized bed heat exchangers the maximum flow rates at which the system may effectively operate normally exceed minimum flow rates by about 33 percent. By example, if the minimum flow rate in a particular conventional system is 75 gallons per minute, the maximum flow rate in the same system would be approximately 100 gallons per minute. The minimum flow rate is determined at the lowest primary medium flow rate that will support fluidization of particulate matter 51 throughout tube 24. Maximum flow rate is determined at the flow rate above which uncontrolled primary medium flow patterns develop within the tubes 24. Development of uncontrolled flow patterns of primary medium 31 within tubes 24 causes a reduction in the heat transfer between primary medium 31 and secondary medium 27. The development of the uncontrolled flow patterns of primary medium at maximum flow rates has been determined by the inventors to be primarily due to the increase of turbulence of the secondary region bed 53. Such turbulence can be reduced by use of impingement plate 50 and to a greater degree the side inlet conduit 34.

The major reduction of the turbulence in secondary region bed 53 is brought about by the use of side inlet conduit 34. Side inlet conduit 34 allows primary medium 31 to enter tubes 24 without percolating through the secondary region bed 53, preventing any unnecessary disturbance in the secondary region bed 53. Experimental data of the inventors has shown that maximum optimal flow rates, when the side inlet conduit 34 is used, have been increased to 200 to 250 percent of minimum flow rates. By example, if the minimum flow rate in the present invention is determined to be 75 gallons per minute the maximum flow rate for the system is at least 150 gallons per minute. Such maximum flow rates are sustained without significant loss of heat transfer capabilities. The quantity of primary medium 31 entering the heat exchanger 10 through base conduit 32 can be maintained at a low level to fluidize secondary region bed 53 without creating any unnecessary turbulence in the secondary region bed 53, while the quantity of primary medium 31 entering the heat exchanger 10 via side inlet conduit 34 can be such as to provide maximum flow rates of up to 250 percent of minimum flow rates without creating uncontrolled primary medium 31 flow patterns within tubes 24. The increased amount of primary medium 31 which can be processed through heat exchanger 10, over the conventional heat exchanger process rate, greatly increases the efficiency and cost effectiveness of the present invention over the prior art.

Another advantage of the present invention over the prior art is the ability to regulate the use of particulate matter 51, without interrupting the operation of the heat exchanger 10. Normally this regulation of particulate matter 51 is utilized when it is determined that only intermediate descaling of tubes 24 is necessary for efficient operation of the heat exchanger 10. In such application the greatest majority of primary medium 31 entering heat exchanger 10 is introduced into the heat exchanger 10 via side inlet conduit 34 and little or no primary medium 31 is passed through base conduit 32 until cleaning is required. By not passing primary medium 31 through base conduit 32 the secondary region bed 53 is not fluidized and no particulate matter 51 is allowed to enter tubes 24. Without particulate matter 51 in tubes 24 higher than normal primary medium 31 flow rates can be generated in heat exchanger 10. When descaling is required the quantity of primary medium 31 entering base conduit 32 is increased to a level sufficient to fluidize the particulate matter 51 within tubes 24. After descaling primary medium 31 is again prevented from entering base conduit 32 and fluidized particulate matter 51 is cleared from the tubes 24. Under this condition the heat exchanger 10 can function in a particulate matter 51 free state. Tube sheet 42 separating regions 38 and 40 is essential to the regulation of the fluidization of particulate matter 51. Tube sheet 42 prevents primary medium 31, entering heat exchanger 10 via inlet conduit 34, from fluidizing the secondary region bed 53, thus, preventing fluidization of particulate matter 51 except as desired.

Figure 2:
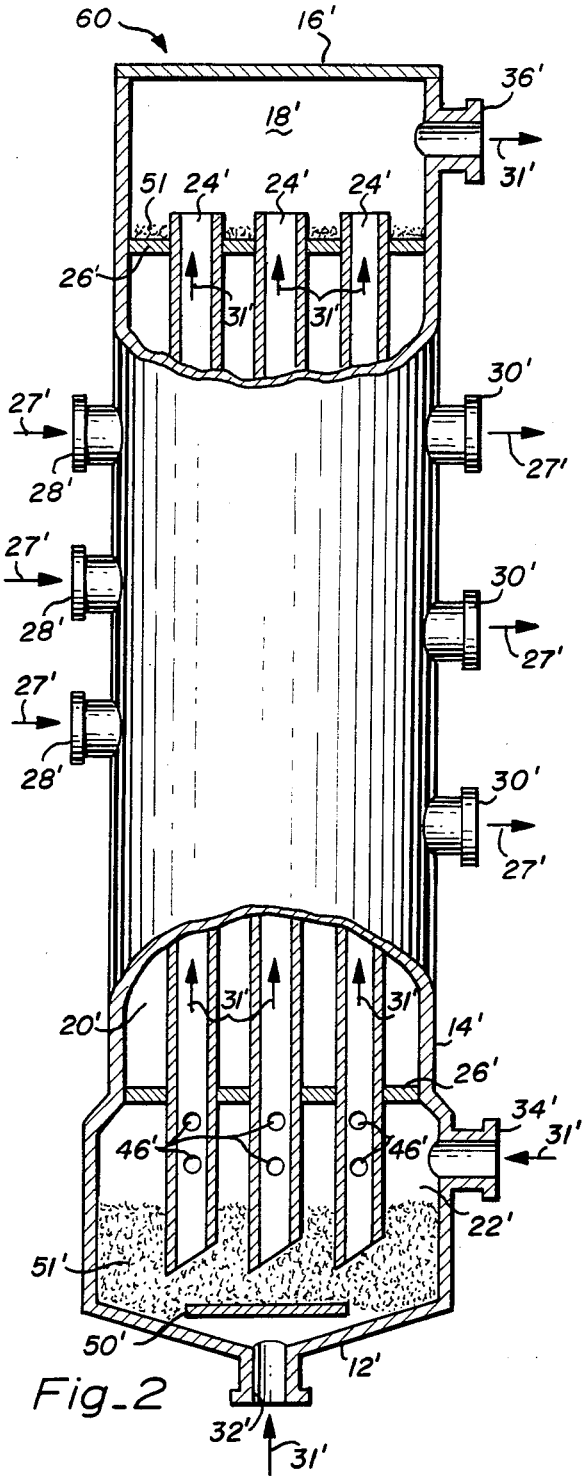
FIG. 2 is a partially exposed elevational view of an alternative embodiment of the fluidized bed heat exchanger of FIG. 1.

FIG. 2 illustrates an alternative embodiment of the fluidized bed heat exchanger and is referred to by a general referrence character 60. Components of FIG. 2 similar to components of FIG. 1 carry the same reference numeral distinguished by a prime designation. The fluidized bed heat exchanger 60 does not have tube sheet 42. Thus, in this configuration regulation of the fluidization of the particulate matter is less precise.

FIG. 3 illustrates an inlet structure of general reference character 70 having a series of inlet devices similar to the components of FIG. 1 carrying the same reference character distinguished by a double prime designation. A first inlet device 44'' has one or several inverted "V" slots 72 in its side wall and extending parallel to the central axis of the inlet device 44''. A second inlet device 44'' has one or more rectangular slots 74 in its side wall as shown. A third inlet device 44'' has one or more apertures 76 in its side wall near the base lower edge of the wall of the device. Such apertures are positioned near the base edge of the device and in parallel alignment to the central axis of inlet device 44''. A fourth device 44'' has its tip angled between zero and 90 degrees. The aforementioned inlet structure 70 designs increase exposure of the tips of inlet devices 44'' so as to desensitize the tube bed 52 to fluctuations in the level of the secondary region bed 53 as discussed.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

We claim:

1. An improved fluidized material heat exchanger comprising:

a. a plurality of substantially parallel tubes for passing a primary medium, each tube having respective upper and lower open end portions joined by a hollow intermediate portion;

b. a collection chamber enclosing said upper open end portions of the tubes and having an outlet conduit for passing said primary medium from the collection chamber;

c. a middle chamber enclosing the intermediate portions of the tubes for passing a secondary medium about the tubes, the middle chamber having at least one inlet conduit and at least one outlet conduit for said secondary medium, and the middle chamber being physically separated in a leak proof manner from the collection chamber;

d. a fluid chamber enclosing said lower open end portions of the tubes, the fluid chamber physically segregated in a leak-proof fashion from the middle chamber; and, said fluid chamber being adapted to contain a quantity of particulate matter which is inert with respect to said primary medium and which is of a size and shape such that said particulate matter can be fluidized by said primary medium and passed upwardly through the tubes without clogging the tubes and capable of descaling the interior surfaces of the tubes;

e. at least one side inlet conduit and a base inlet conduit at predetermined locations in the walls and base, respectively, of said fluid chamber for concurrently receiving and passing said primary medium to the interior of said fluid chamber;

f. at least one of said second end portions of the tubes is a tube inlet device having a side wall with at least two apertures, one at an elevation above the other, said apertures being of a size and shape so as to permit unrestricted passage of said particulate matter and said primary medium through the apertures, and the tube inlet device has a hollow tip portion through which said primary medium and said particulate matter may pass; and g. the size and location of said apertures is determined by the equations:

$$\tfrac{1}{2}D_N \leqq A_N \leqq [L-\tfrac{1}{2}D_N];$$

and $$0.004[OD^2\pi \leqq [D_1^2+D_2^2+D_3^2+\ldots D_N^2] \leqq 3[OD^2]$$

with

N = the number of apertures;

$D_N$ = the diameter of the Nth aperture;

OD = the overall diameter of the tube inlet devices;

L = the overall length of the tube inlet devices; and $A_N$ = the distance from the lower edge of the tube inlet device to the center point of the Nth aperture.

2. A method for descaling tubes and regulating the amount of fluidized particulate matter in a fluidized bed heat exchanger having a plurality of hollow parallel tubes for passing a primary medium into a collection chamber through a middle chamber from a fluid chamber while a secondary medium is passed through the middle chamber and bathes said tubes, said collection chamber incorporating at least one outlet conduit for passing said primary medium, said fluid chamber being subdivided into a primary region and a secondary region by a partition wall such that said two regions are physically isolated from each other in a leak proof manner, said primary region having a side inlet conduit mounted in the side of said fluid chamber, said secondary region having a base inlet conduit mounted in the base of said fluid chamber, said tubes extending through said primary region and terminating in said secondary region, the portion of the tube in said primary region having portions defining at least two apertures aligned parallel to the central axis of the tube such that primary medium entering the primary region via side inlet conduit can pass into the tubes via the apertures and in said secondary region is a bed of particulate matter for cleaning the interior surfaces of the tubes which is capable of being fluidized by the primary medium and passing into the tubes from said secondary region, comprising the steps of:

introducing said primary medium simultaneously into the side and base inlet conduits under pressure when descaling is desired, and substantially filling the primary region with said primary medium passing through the side inlet conduit to cause said primary medium to pass into said tubes through the tube inlet device apertures, and causing the primary medium passing through the base inlet conduit to fluidize said particulate matter residing within the secondary region;

passing said fluidized particulate matter in said secondary region up into the tubes to comingle with said primary medium entering said tubes through the tube inlet device apertures located in the primary region, passing said commingled medium through said tubes to said collection chamber to descale said tubes;

discharging said commingled medium from said collection chamber;

flowing a secondary medium through said middle chamber and bathing the outer surfaces of the tubes so as to heat or cool the tubes as desired; and reducing the flow of said primary medium to the base inlet conduit to prevent particulate matter from said secondary region from being fluidized and entering said inlet devices while maintaining the flow of the primary medium entering the heat exchanger via the side inlet conduit when descaling is not desired.

3. The fluidized bed heat exchanger of claim 1 further including an impingement plate located in said fluid chamber about the base inlet conduit such that at least a portion of said primary medium passing through the base inlet conduit encounters the impingement plate, the impingement plate being of a size and shape to prevent backflow of said particulate matter through the base inlet conduit.

4. The fluidized bed heat exchanger of claim 1 wherein said fluid chamber is subdivided into a primary region and a secondary region, said primary and secondary regions being physically isolated from each other in a leak proof manner, said primary region being in open communication with the side inlet conduit and the secondary region being in open communication with the base inlet conduit.

5. The fluidized bed heat exchanger of claim 4 wherein the inlet device extends through said primary region and terminates in said secondary region with the apertures in the inlet tube device being located in said primary region and the tip of the inlet device being located in said secondary region, the inlet device being supported by a partition segregating said primary and secondary regions in a leak proof manner so that said primary medium fluid flow between said primary and secondary regions is concentrated through the tube inlet devices.

6. The fluidized bed heat exchanger of claim 5 wherein the tip of the inlet device is formed with at least one inverted "V" shaped aperture portion positioned in a predetermined location in the lower leading edge of said tip.

7. The fluidized bed heat exchanger of claim 5 wherein a plurality of said end portions are tube inlet devices; and the tip of at least one of the inlet devices is formed with at least one rectangular aperture positioned in a predetermined location in the lower leading edge of said tip.

8. The fluidized bed heat exchanger of claim 5 wherein a plurality of said end portions are tube inlet devices; and the tip of at least one of the inlet devices has a plurality of holes positioned in alignment parallel to the central axis of the inlet device.

9. The fluidized bed heat exchanger of claim 5 wherein a plurality of said end portions are tube inlet devices; and the tip of at least one of the inlet devices has a lower leading edge angled greater than 0° and less than 90° off the perpendicular central axis of the inlet device.

10. The fluidized bed heat exchanger of claim 3 wherein a plurality of said end portions are tube inlet devices; and the tip of at least one of the inlet devices has a portion defining an inverted "V" shaped aperture positioned about the lower leading edge of said tube.

11. The fluidized bed heat exchanger of claim 3 wherein a plurality of said end portions are tube inlet devices; and the tip of at least one of the inlet devices has a portion defining a rectangular aperture positioned about the lower leading edge of said tube.

12. The fluidized bed heat exchanger of claim 3 wherein a plurality of said end portions are tube inlet devices; and the tip of at least one of the inlet devices has a plurality of apertures positioned in alignment parallel to the central axis of the tube.

13. The fluidized bed heat exchanger of claim 3 wherein a plurality of said end portions are tube inlet devices; and the tip of at least one of the inlet devices has a lower leading edge angled greater than 0° and less than 90° off the perpendicular central axis of the tube.

14. The fluidized bed heat exchanger of claim 6 wherein the inlet device is a hollow tube portion joined to said second end portion of said tube residing in said fluid chamber.

15. The fluidized bed heat exchanger of claim 7 wherein each of the inlet devices is a hollow tube portion joined to said second end portion of one of said tubes residing in said fluid chamber.

16. The fluidized bed heat exchanger of claim 8 wherein each of the inlet devices is a hollow tube portion joined to said second end portion of one of said tubes residing in said fluid chamber.

17. The fluidized bed heat exchanger of claim 9 wherein each of the inlet devices is a hollow tube portion joined to said second end portion of one of said tubes residing in said fluid chamber.

18. The fluidized bed heat exchanger of claim 10 wherein the inlet device is a hollow tube portion joined to said second end portion of said tube residing in said fluid chamber.

19. The fluidized bed heat exchanger of claim 11 wherein each of the inlet devices is a hollow tube portion joined to said second end portion of one of said tubes residing in said fluid chamber.

20. The fluidized bed heat exchanger of claim 12 wherein each of the inlet devices is a hollow tube portion joined to said second end portion of one of said tubes residing in said fluid chamber.

21. The fluidized bed heat exchanger of claim 13 wherein each of the inlet devices is a hollow tube portion joined to said second end portion of one of said tubes residing in said fluid chamber.

* * * * *